US005330229A

United States Patent [19]

Zoltner

[11] Patent Number: 5,330,229

[45] Date of Patent: * Jul. 19, 1994

[54] COMPLETED BOOK AND A CASE FOR MAKING THE BOOK

[75] Inventor: John D. Zoltner, Rochester, N.Y.

[73] Assignee: Xerox Corporation, Stamford, Conn.

[ * ] Notice: The portion of the term of this patent subsequent to Jan. 22, 2008 has been disclaimed.

[21] Appl. No.: 991,457

[22] Filed: Dec. 16, 1992

Related U.S. Application Data

[60] Continuation of Ser. No. 486,456, Feb. 28, 1990, abandoned, which is a division of Ser. No. 369,482, Jun. 20, 1989, Pat. No. 5,061,139.

[51] Int. Cl.[5] ..... B42D 5/00

[52] U.S. Cl. ..... 281/15.1; 281/29; 281/28; 412/6; 412/19; 412/23; 412/34

[58] Field of Search ..... 281/29, 15.1, 21.1, 281/28; 412/3, 4, 5, 6, 9, 17, 18, 19, 21, 33, 34, 37, 900, 901, 902

[56] References Cited

U.S. PATENT DOCUMENTS

| | | | |
|---|---|---|---|
| 972,617 | 10/1910 | Gieseoke et al. . | |
| 2,526,270 | 10/1950 | Phillips | 281/21 |
| 2,583,403 | 1/1952 | Wiser | 281/27 |
| 2,607,614 | 8/1952 | Wiser | 281/21 |
| 2,743,467 | 5/1956 | Gustafson | 11/1 |
| 2,852,275 | 9/1958 | Brook | 281/31 |
| 3,284,102 | 11/1966 | Sack | 281/21 |
| 3,570,071 | 3/1971 | Wardell | 24/67 |
| 3,707,418 | 12/1972 | Bhagat | 412/902 |
| 3,749,423 | 7/1973 | Abildgaard | 281/21 |
| 3,788,921 | 1/1974 | Polit et al. | 156/216 |
| 3,925,126 | 12/1975 | Leatherman et al. | 156/73.6 |
| 3,946,867 | 3/1976 | McGuire et al. | 206/450 |
| 3,954,548 | 5/1976 | Polit | 412/900 |
| 4,077,078 | 3/1978 | Snellman et al. | 11/1 AD |
| 4,091,487 | 5/1978 | Axelrod | 11/1 AD |
| 4,150,453 | 4/1979 | Vaughn | 11/3 |
| 4,178,201 | 12/1979 | Power | 412/902 |
| 4,244,069 | 1/1981 | Hale | 412/900 |
| 4,351,546 | 9/1982 | Cognata | 412/3 |
| 4,441,950 | 4/1984 | Lolli | 156/216 |
| 4,527,814 | 7/1985 | Carter | 412/3 |
| 4,583,877 | 4/1986 | Wilson | 402/75 |
| 4,793,758 | 12/1988 | Hanson et al. | 412/4 |
| 4,818,168 | 4/1989 | Battisti | 412/37 |
| 4,934,738 | 6/1990 | Colonna | 281/21.1 |
| 4,986,713 | 1/1991 | Zoltner | 412/34 |
| 5,061,139 | 10/1991 | Zoltner | 412/8 |

FOREIGN PATENT DOCUMENTS

| | | | |
|---|---|---|---|
| 0654919 | 6/1963 | Italy . | |
| 926330 | 5/1963 | United Kingdom . | |
| 1277707 | 6/1972 | United Kingdom | B42F 21/02 |
| 2145033A | 3/1985 | United Kingdom . | |

*Primary Examiner*—Paul A. Bell

[57] ABSTRACT

A bindery system captures pages of a bound or unbound book in a hard or soft cover case with a metal U-shaped channel which in turn is bonded to the inside spine surface of the hard or soft covers.

14 Claims, 13 Drawing Sheets

COMPLETED BOOK AND A CASE FOR MAKING THE BOOK

This is a continuation of application Ser. No. 07/486,456, filed Feb. 28, 1990, now abandoned, which is a divisional of application Ser. No. 07/369,482, filed Jun. 20, 1989 which is now U.S. Pat. No. 5,061,139.

This invention is directed generally to the binding of bound or unbound books, and in particular is concerned with improvements in the manner in which hardback covers are assembled and secured to the books.

Sheet binding is one of the oldest known arts, and numerous methods and apparatus are known in the art for permanently or temporarily securing sheets together. Many of these, of course, are only economically suited for high priced or high volume commercial printing operations. There is a long standing need for improved sheet fastening means for localized, simple and inexpensive binding of, for example, stacks of twenty to 300 pages.

This need has been greatly increased by the widespread use of xerographic equipment, where large numbers of printed sheets are produced by relatively unskilled personnel in non-commercial printing operations. The demand for simplicity and economy in these applications has continued to retain conventional metal staples as the primary fastening means. This is in spite of the fact that stapling, riveting or other sheet binding means requiring penetration of the sheet crates stress points in the sheets which encourage sheet tearing and inadvertent sheet removal. So does any sharp edges of the staples or rivets. Further, the pull-off strength of the top and bottom sheets in any stack fastened in this conventional manner is limited by the strength of the sheet over the small areas directly underlying the heads of the staple or rivet.

Thus, it is clear that a sheet binding method which provides intersheet adhesion over a much larger binding area than staples or rivets, and which does not require any sheet penetration or sharp edges, is greatly preferable. Various adhesive bonding methods have been developed which have suitable binding strength but they have not achieved widespread utilization in many low volume binding applications, apparently because they are not sufficiently simple and economical in comparison to metal staples or rivets. They require the supplying, handling and containment of separate adhesive materials.

There is a need in the finishing industry for an upscale hardback cover look which transforms the utilitarian soft cover type bound copy set into an expensive "limited edition" library bound look. Attempts have been made in the past at filling this need. For example, one binding system is available that uses an adhesive to bind pages of a book to the spine of a hardback cover and does not positively lock the pages to the cover, therefore, it is easy to cause the pages to unbind. In another bindery system, attachment holes must be punched in all pages that are to be placed within hardback covers. This is a slow and tedious process. There is also the substantial cost of the punching and case centering devices. A loose leaf binder made by Elbe Products, 649 Alden St., Fall River, Mass. uses a spring steel internal mechanism to retain pages. To open the binder, the hard covers are pressed backward. This opens the retaining spring. Plastic retaining clips enclosed herewith have also been used in the past to hold loose leaf sheets and cover sheets together.

Patents of interest include U.S. Pat. No. 972,617 which discloses a book binding glue press for compressing and binding a book on three sides thereof simultaneously. The binder is adjustable to accommodate books of varying thicknesses. The compressed book is glued to a flexible cover while in the binder. A lever is used to manually compress and release the binder. In U.S. Pat. No. 2,583,403, a book binding technique using a U-shaped member 17 is shown for protecting and sealing the back edges of a book. A book binding machine is disclosed in U.S. Pat. No. 2,743,467 for binding records and reports for businesses. A U-shaped end cap made of bendable metal is used to bind the records together along with a hard front and rear cover. Slots are cut into two sides of the records stack near the bind area and fit with binding strips to maintain record integrity and keep pages from falling out of the binder. U.S. Pat. No. 2,852,275 shows a transparent window for showing a label or title of a book. The window may be on the front cover or the spine. Title cards may be slipped behind the window under a cover plate. A method for binding books is shown in U.S. Pat. No. 4,091,487 having a plurality of signatures glued together along a spine. The front and back sheets are of heavier paper stock. A paper cover of the heavier stock having a size to cover three sides of the book is glued to the book and to the entire inside surface of the hardcover. Great Britain Patent No. 926,330 discloses a method of book binding wherein a U-shaped clip 12 is clamped so as to tightly clamp a book and outer cover together, however, the problem with this type of binding is that the clamp is on the outside of the book thereby preventing the bound documents from looking like a classic book. In Great Britain Patent No. 1,277,707, a loose leaf binder is disclosed having a removable portion of the outer spine to form a window through which a label can be inserted. U.S. Pat. No. 3,749,423 directed to assembling of an uncased book to a case. None of these methods and apparatuses appear to answer the heretofore mentioned problems.

Accordingly, a fast, cost effective method and apparatus for binding pages of a bound or unbound book or documents to a hard or soft back cover that is not labor intensive is disclosed with the method of one embodiment including the steps of: providing a case that includes front and back covers and a spine portion with an adhesive material applied to the inside surface of the spine; adhering a U-shaped channel member to the adhesive material; inserting either bound or unbound pages into the channel member; and crimping the outside spine area of the case to attach the case to the pages to thereby form a bound book.

For a general understanding of the features of the present invention, reference is made to the drawings. In the drawings, like reference numerals have been used throughout to designate identical elements.

Figure 1:
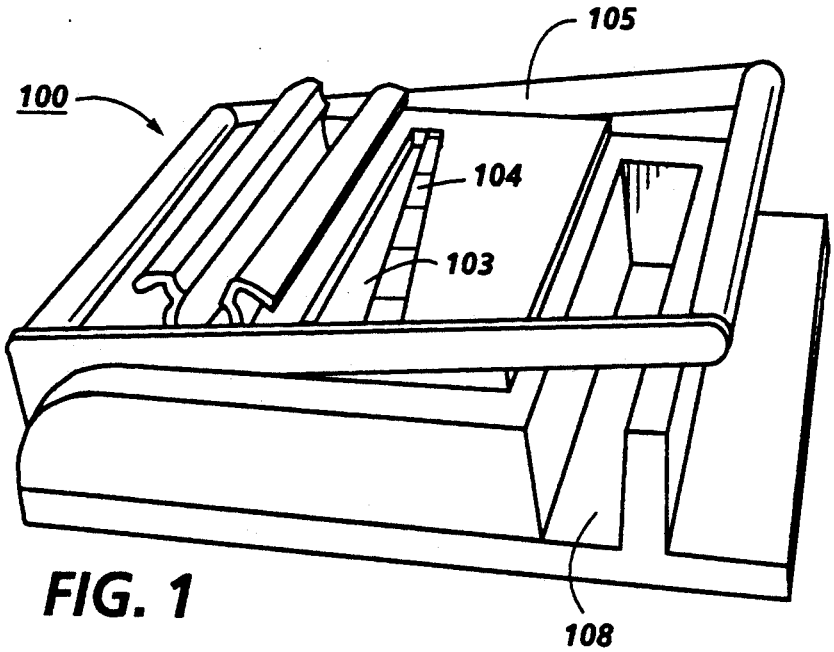
FIG. 1 is a side perspective of a binder apparatus with its crimping handle down with which the method of the present invention is employed.
Figure 2:
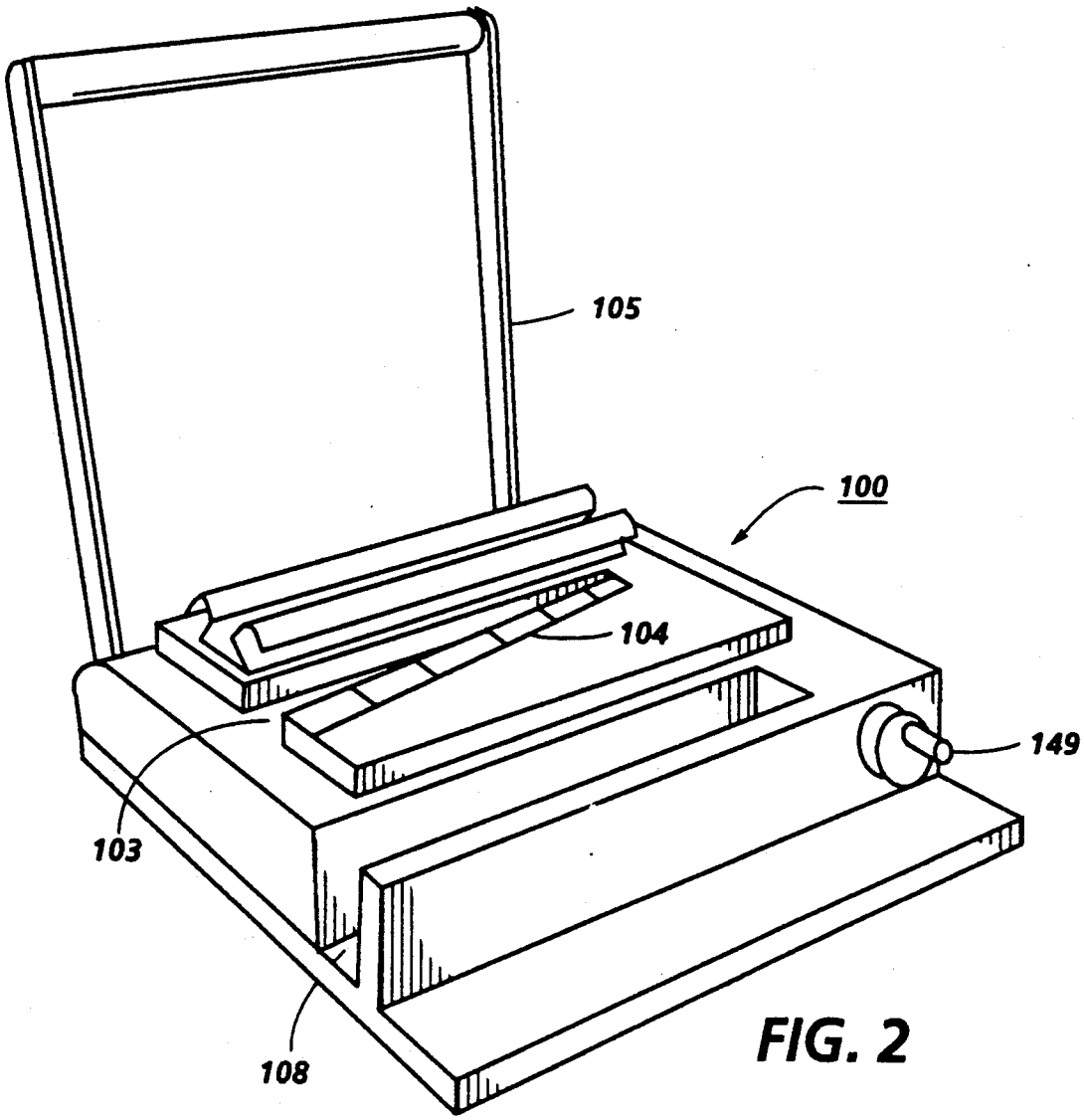
FIG. 2 is an isometric view of the apparatus of FIG. 1 with its crimping handle up.
Figure 3:
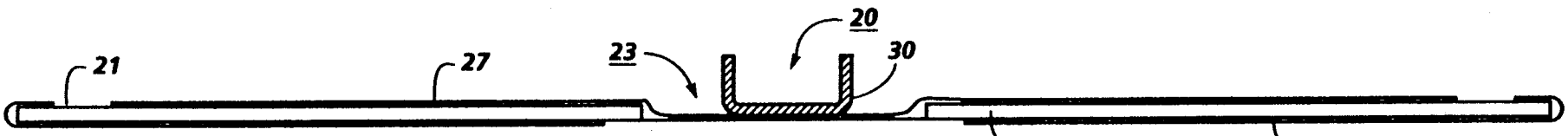
FIG. 3 is an end view of a casebook with a crimping channel attached to its spine.
Figure 4:
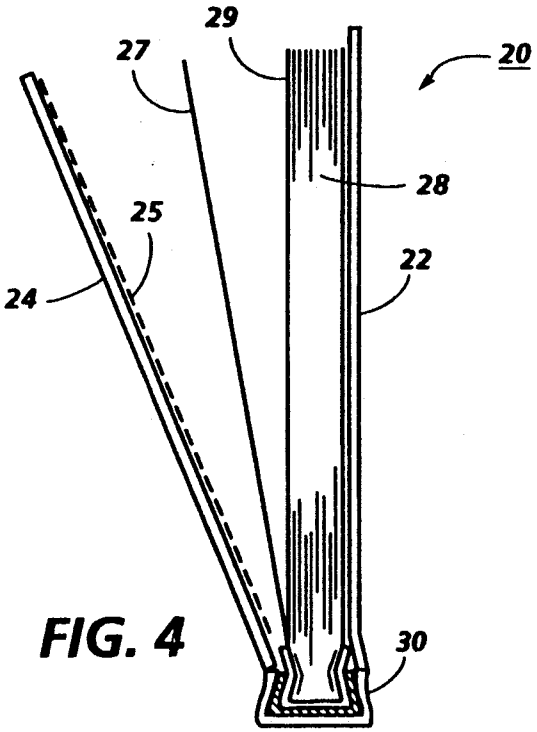
FIG. 4 is an enlarged partial side elevational cross-section of a casebook with covering material being removed from an adhesive material on the inside surface of one of its hard back covers.

Referring to FIGS. 1 and 2 of the drawings, there is shown by way of example a binding machine, designated generally by the numeral 100 incorporating the features of the present invention. Books that can be bound by the binding machine 100 include the bookcase 20 shown in FIGS. 3 and 4. Bookcase 20 has hard back boards 22 and 24 that are covered by a cloth or paper covering material 21 which has a spine portion 23 positioned between hard back covers 22 and 24. An adhesive material 25 on the inside surfaces of the hard back covers has release sheets 27, such as paper, covering the adhesive material. The spine 23 of the bookcase 20 has a smooth inner surfaced U-shaped, rounded interior radiused bind channel or binding member 30 attached to it by an an appropriate glue. It should be understood that the channel member can be attached to the case by any suitable means, for example, riveting, double sided tape, snapped, screwed, etc. [U-shaped channel member or channel means 30 is preferably made of steel, however, any material that reacts with plastic deformation could be used as long as it is strong enough to hold the paper.] Channel sizes are supplied according to the number of pages to be cased, for example, channel sizes A, B, C, D, E, F, and G of gage 103 to be described hereinafter, have a width in inches +/−0.005 of about 0.41, 0.52, 0.64, 0.80, 0.96, 1.12 and 1.28, respectively. Ordinarily, the walls of the channel member have a height of about 0.25 +/−0.005 inches. The bookcase is adapted to be placed within a bookcase cradle 108 of binding machine 100. A book of separate and individual sheets or pages 28 with thicker end leaves 29 is placed within channel member 30 and the channel member is crimped against the sides of the end leaves to attach the bookcase to the pages of the book. The channel member may optionally have a layer of resilient material added to the insides of the walls to maintain the clamping force. The bookcase is then removed from the binder and release paper 27 is removed from the inside surfaces of hard back covers 22 and 24 and the covers are pressed against the end leaves in order to adhere the hard back covers to the end leaves and to present a view to the reader that does not include channel member 30. Soft covers could be used in place of the hard back covers.

Figure 5:
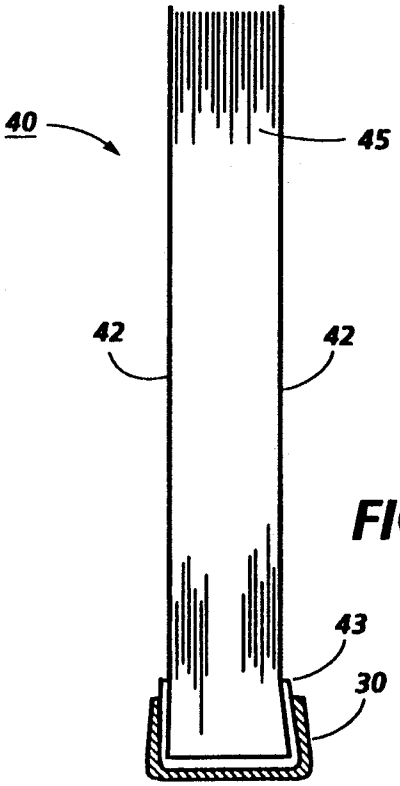
FIG. 5 is an end view of an embodiment of the present invention showing a hot melt bound book after it has been crimped by a metal channel member.

In FIG. 5, channel member 30 is shown crimped around a book that has been previously bound with a hot melt tape 43. With channel member 30 having been adhered to a hard back cover 20, the previously bound book 40 with soft outer covers 42 is placed within the channel member and the channel member is crimped by the use of binding machine 100. This procedure gives soft and hard cover books the look of professional binding.

Figure 6:
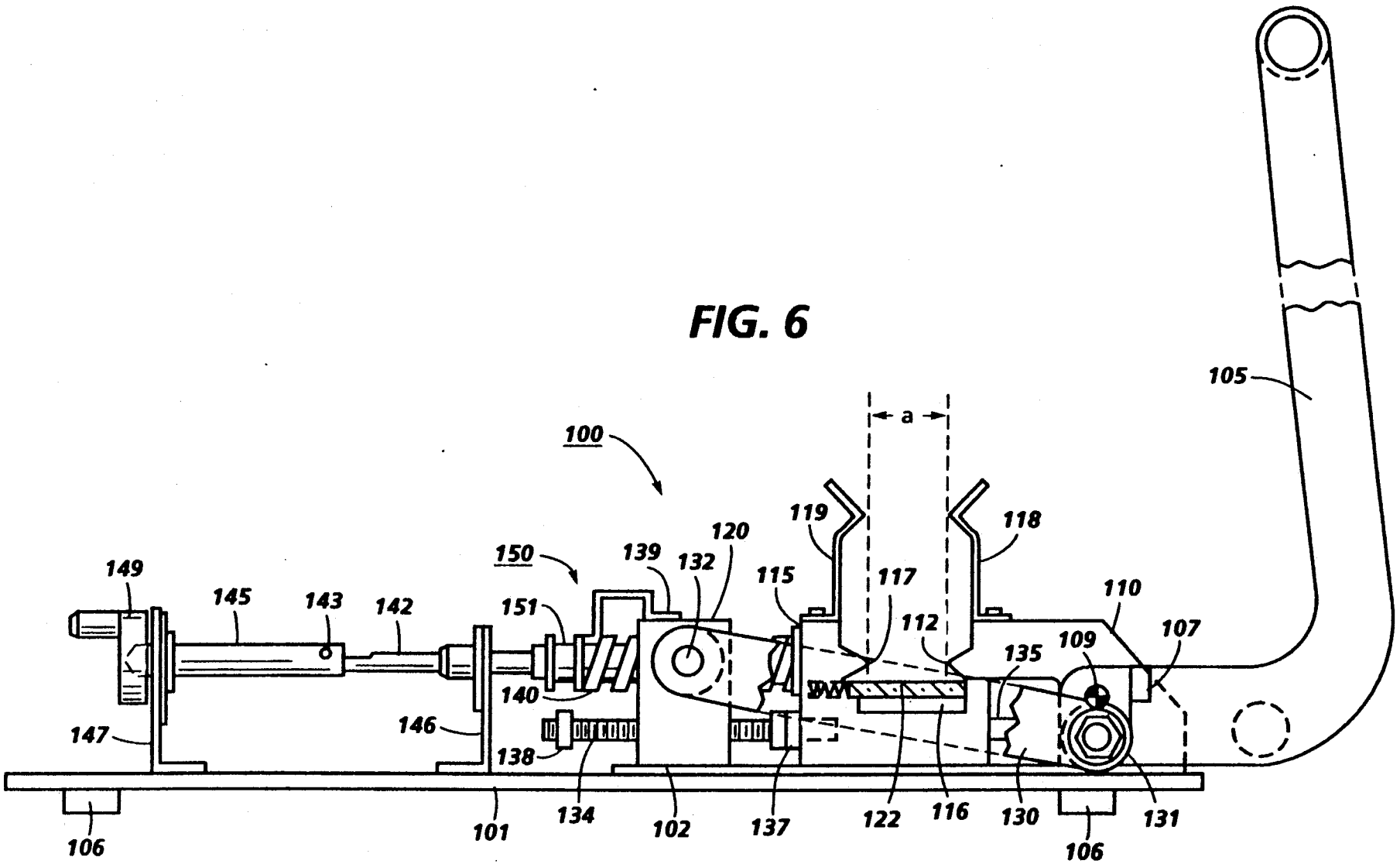
FIG. 6 is an enlarged side elevation of the binder apparatus of FIG. 1 with its actuating handle in an open position.
Figure 7:
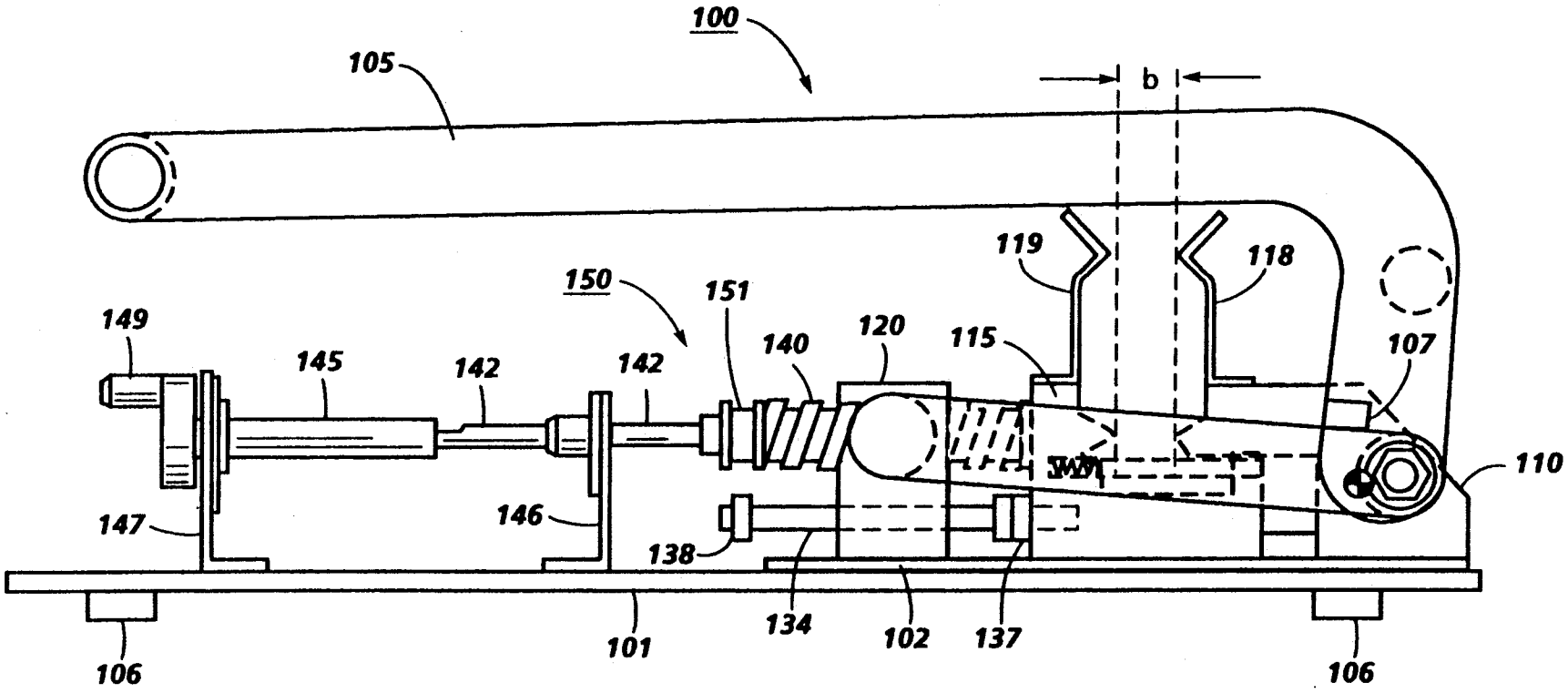
FIG. 7 is an enlarged side elevation of the binder apparatus of FIG. 1 with its actuating handle in its closed position.
Figure 8:
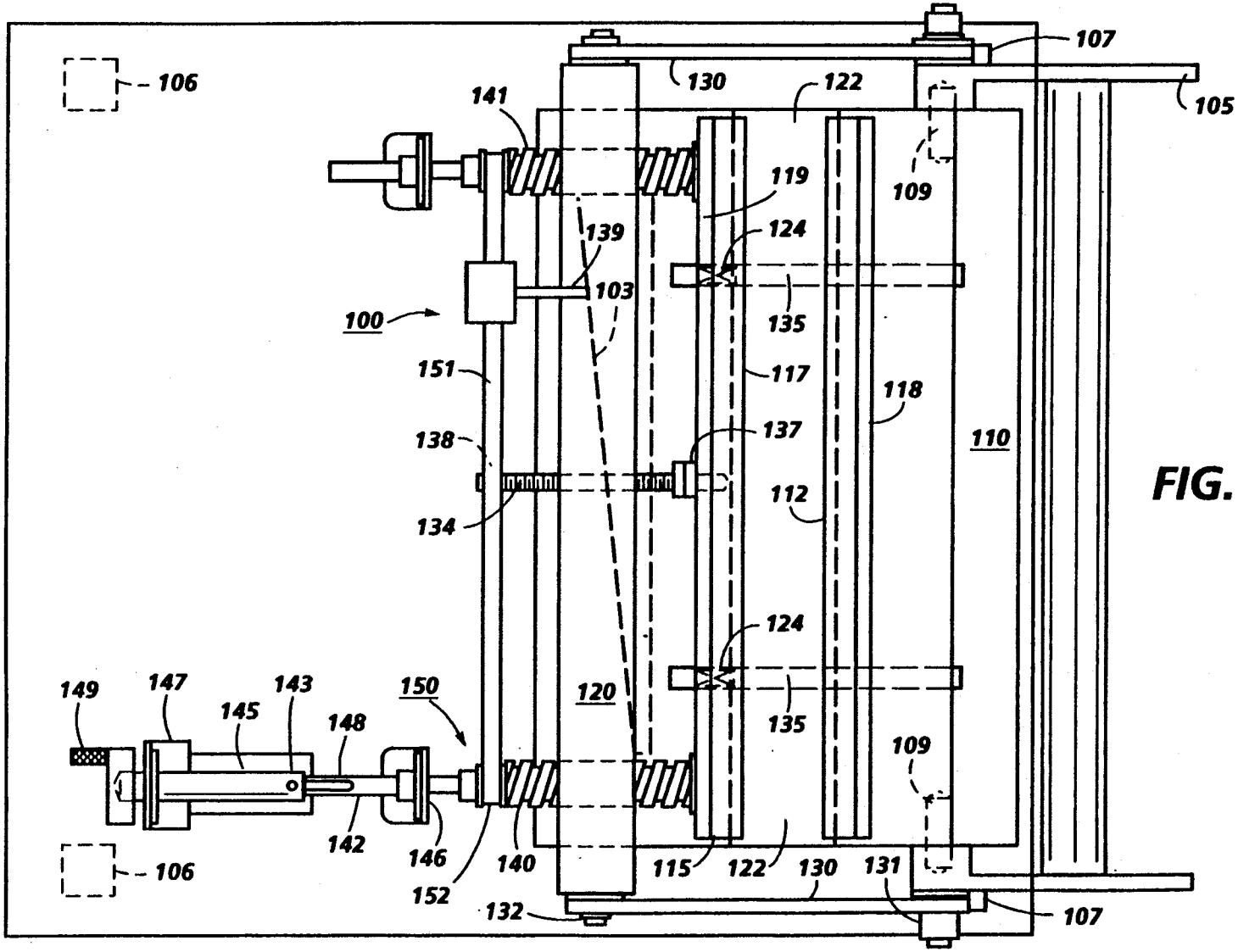
FIG. 8 is an enlarged plan view of the binder apparatus of FIG. 6.
Figure 9A:
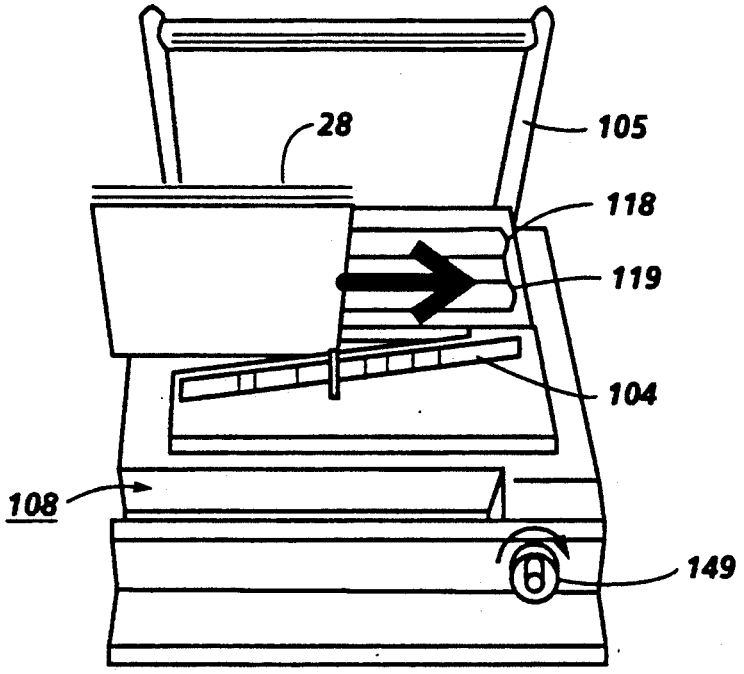
FIGS. 9A-9D are schematic views of the binder apparatus of FIG. 1 showing the operational sequence for binding a book in accordance with the present invention.
Figure 9B:
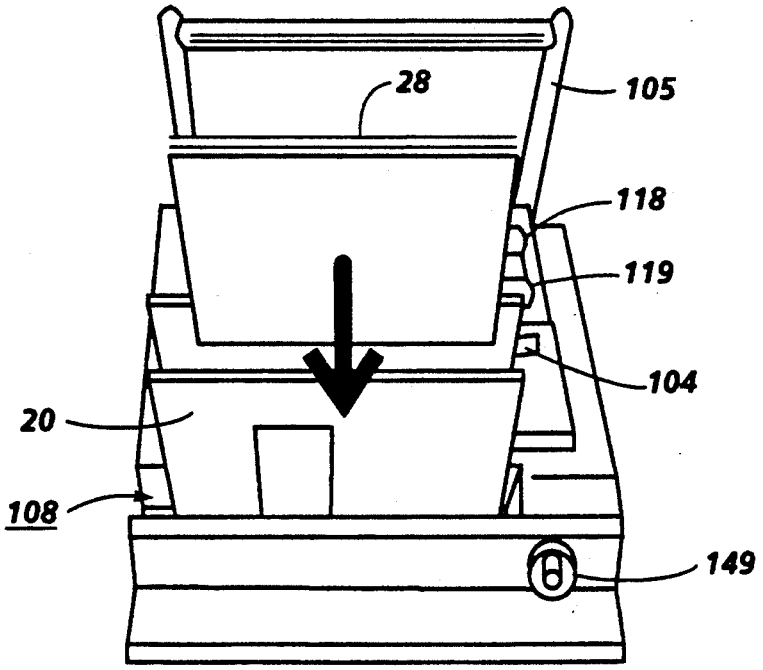
Figure 9C:
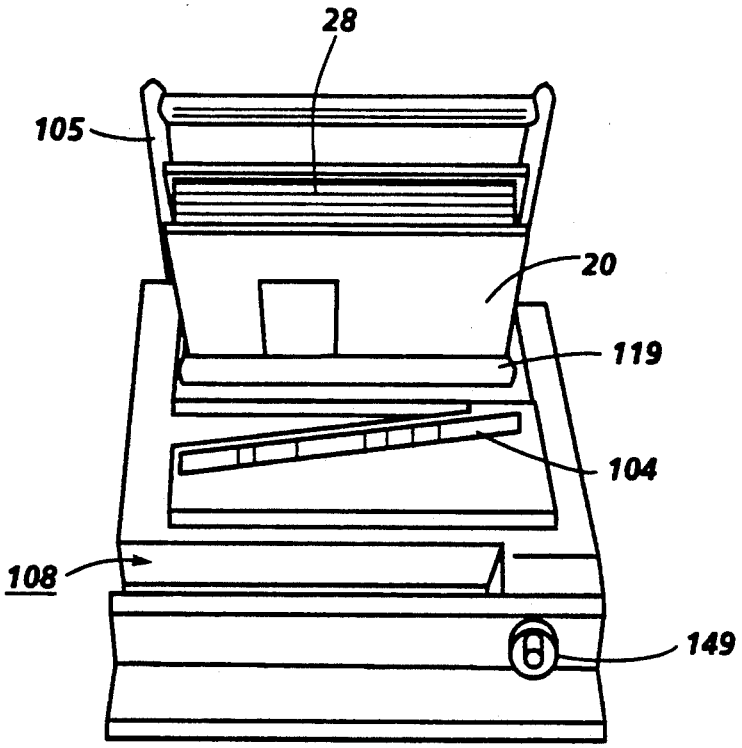
Figure 9D:
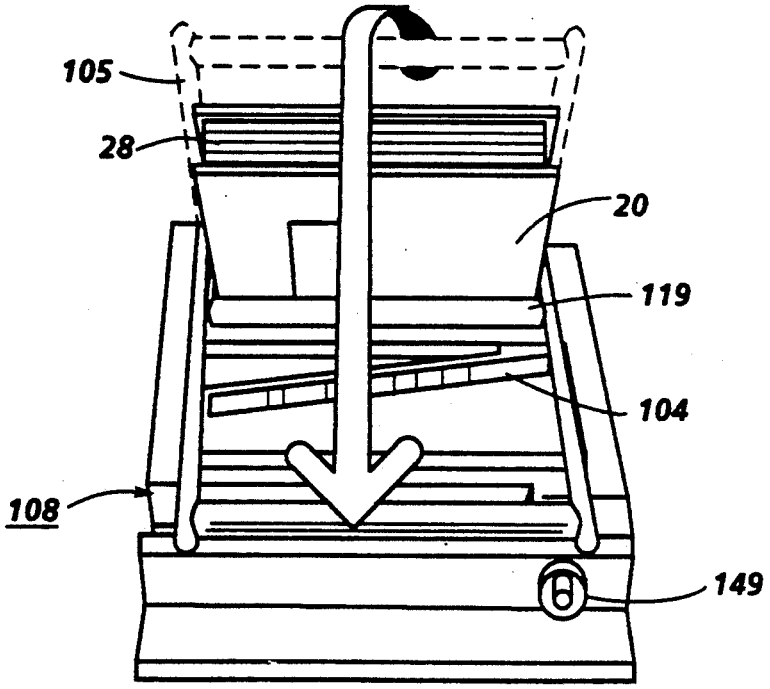

The demand book binder 100 in FIGS. 6, 7 and 8 is assembled to a base plate 101 supported by foot pads 106. A low friction pad 102 and stationary jaw 110 are attached to the base plate. Movable jaw 115 and housing 120 are mounted above the pad and slide on it. The fixed and movable jaws include beveled clinch members 112 and 117, respectively, and have guides 118 and 119 mounted thereon that control the positioning of the bookcase(s) 20. The movable jaw 115 slides on guide rods 135 supported by fixed jaw 110, to maintain alignment between clinch members. A link member 130 is supported for movement about shafts 131 and 132 and connects to the fixed jaw 1100 via handle pivot shaft 109.

The adjustment of the gap between clinch members 112 and 117 for different size books is accomplished by the action of lead screws 140 and 141, which are synchronized together by the toothed belt 151 and the toothed pulleys 152 and 153. The lead screws operate in threaded holes in housing member 120 to adjust the space between the housing member and the movable jaw 115. The limits of this adjustment are set by stop screw 134 and stops 137 and 138.

The adjustment handle 149 and hollow shaft 145, are supported by bracket 147, and are rotationally connected to shaft 142, supported by bracket 146, by the action of pin 143 riding in slot 148. This allows the handle location to remain fixed as the lead screw moves in and out. Pointer 139 is attached to toothed belt 151 and moves with it as the lead screws are rotated. Adjustment is complete when the pointer lines up with the end of the set of pages 28 which have been inserted as far as they will go into the tapered thickness gage 103. A size selection dial 104 associated with the thickness gage indicates the proper bookcase 20 size to use.

Handle 105 is shown in its up or home position in FIG. 6, and is pivotable about shaft and pivot point 109 in order to change the dimension between the fixed and movable jaws and crimp the bookcase placed within jaws 115 and 110. Movement of handle 105 also changes the dimension between the guide members 118 and 119 from a "a" in FIG. 6 to "b" in FIG. 7. As seen in FIG. 8, the handle includes two upright arms that are connected at their outer extremities by a horizontal cross member and provide an open space therebetween in order to not interfere with bookcases as the handle is manipulated in up and down channel crimping action.

A movable elastomer bed 122 is mounted in movable jaw 115 over recess 116, into which it can deflect when it flexes. The elastomer bed is free to move with respect to jaw 115 and is biased by compression spring 124. The elastomer bed and recess allow the spine of bookcases 20 to expand downward as it is crimped by movement of handle 105 thereby ensuring a traditional appearance of the final book.

The operation of demand book binder 100 is shown in FIGS. 9A–9D. The binder handle is in its vertical or open position. Sheets 28 to be bound are first jogged for alignment of all edges and then placed within thickness gauge 103. While holding pages 28 in this position, bookcase size selection pointer or position indicator 139 is moved by rotating the crank 149 until the pointer is aligned with the end of the pages. The pointer is now positioned over the proper size bookcase for the pages as seen on the bookcase size selection dial 104 which lies beneath the pointer and lists bookcase sizes A through G. A selected bookcase as indicated beneath pointer 139 is placed into bookcase cradle 108 with the front cover facing the operator and the bottom of the bookcase against the end wall of the cradle. Preferably, the front cover and spine of the bookcase has a colored panel suitable for the placing of title material thereon. The pages 28 are now placed into the open bookcase and down against the bind channel 30 with the title page orientated toward the operator. The bottom edge of the pages is now squared up by grasping the pages and gently rapping that edge against the wall of the cradle while holding the bookcase against the same wall. As a result of the preceding procedure, both the top and bottom edges of the pages are now squared off. Holding the pages firmly, as well as the bookcase, pull the pages back into the bookcase until both ends of the pages are aligned with the ends of the bind channel. Next, the bookcase is closed and removed from the cradle and inserted into the book binder and onto elastomer bed 122 with the colored spine oriented downward and released once the bookcase is resting against the elastomer bed. The middle of binding handle 105 is now grasped with both hands and pulled toward the operator and down until stop 107 comes to rest on link member 130. The bind channel has now been crimped against the pages inserted therein to form a uniquely bound book. The handle is now raised to its original vertical position in order to remove the bound book and to ready the binder for the next book bind. Creation of the front cover and spine title labels and their attachment to the bookcase can now take place. Bookcase title labels can be printed or typewritten and placed on the front and spine panels. For example, a recessed insert area is included in the front cover of the bookcase. Into this recessed area is hot foil stamped a colored background and onto which is attached a transparent coating of adhesive that is protected by a strip of protective paper. The colored foil has a dry, heat activated adhesive on its back side. A hot platen, with pressure, forces the color into the cover, melts the adhesive between the color and the cover, and causes the foil to adhere to the cover. Later the title label is created by typing directly on the label or creating the title on a computer and printing the title onto the label by use of a laser printer. The label is transparent plastic weakly bonded to a paper support (which carries it through a printer or typewriter). Once printed, the label is stripped from the paper support and laid over the colored panel and bonded by means of the adhesive on the backside of the label (which had previously held the label to the support paper).

Figure 10:
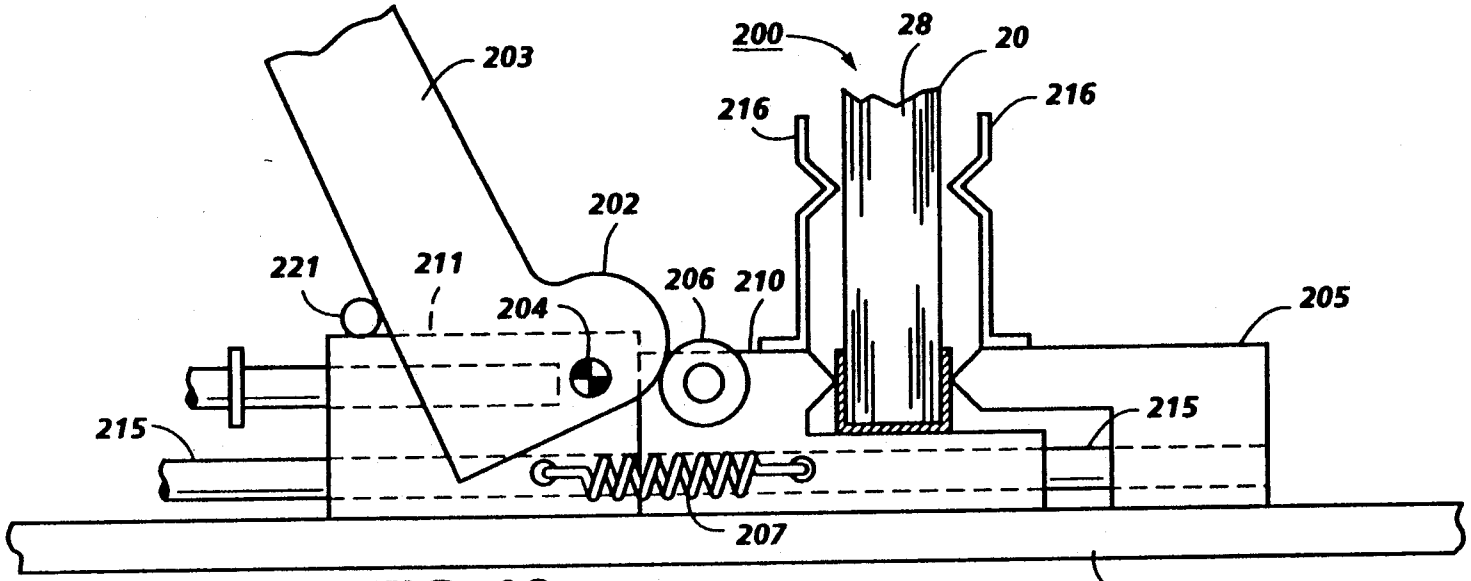
FIG. 10 is an enlarged partial side elevation of an alternative embodiment of the binder apparatus of the present invention with its actuating handle in an open position.
Figure 11:
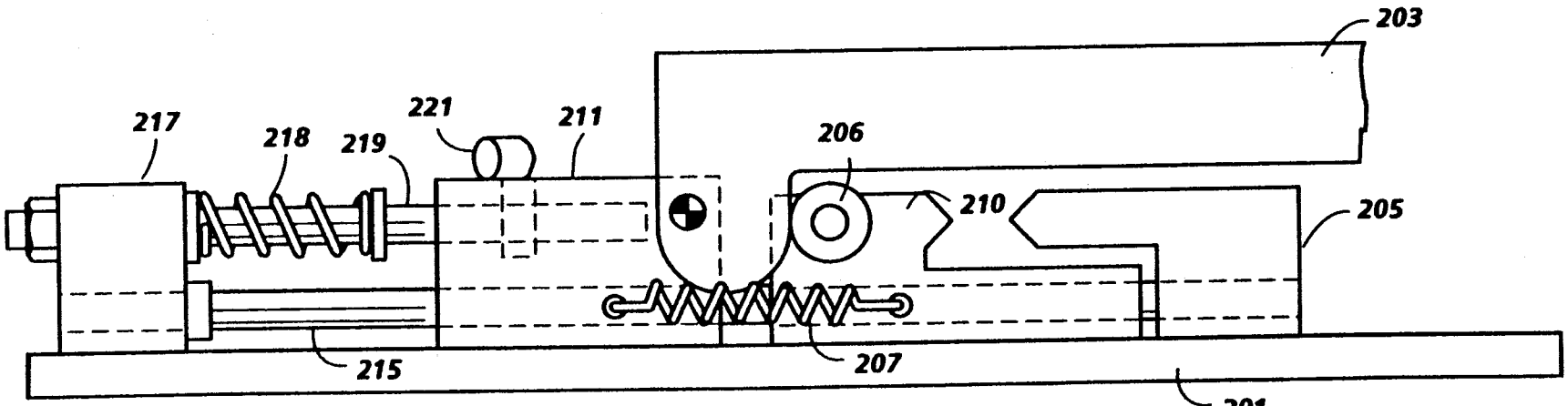
FIG. 11 is an enlarged partial side elevation of the binder apparatus of FIG. 10 with its actuating handle in its closed position.
Figure 12:
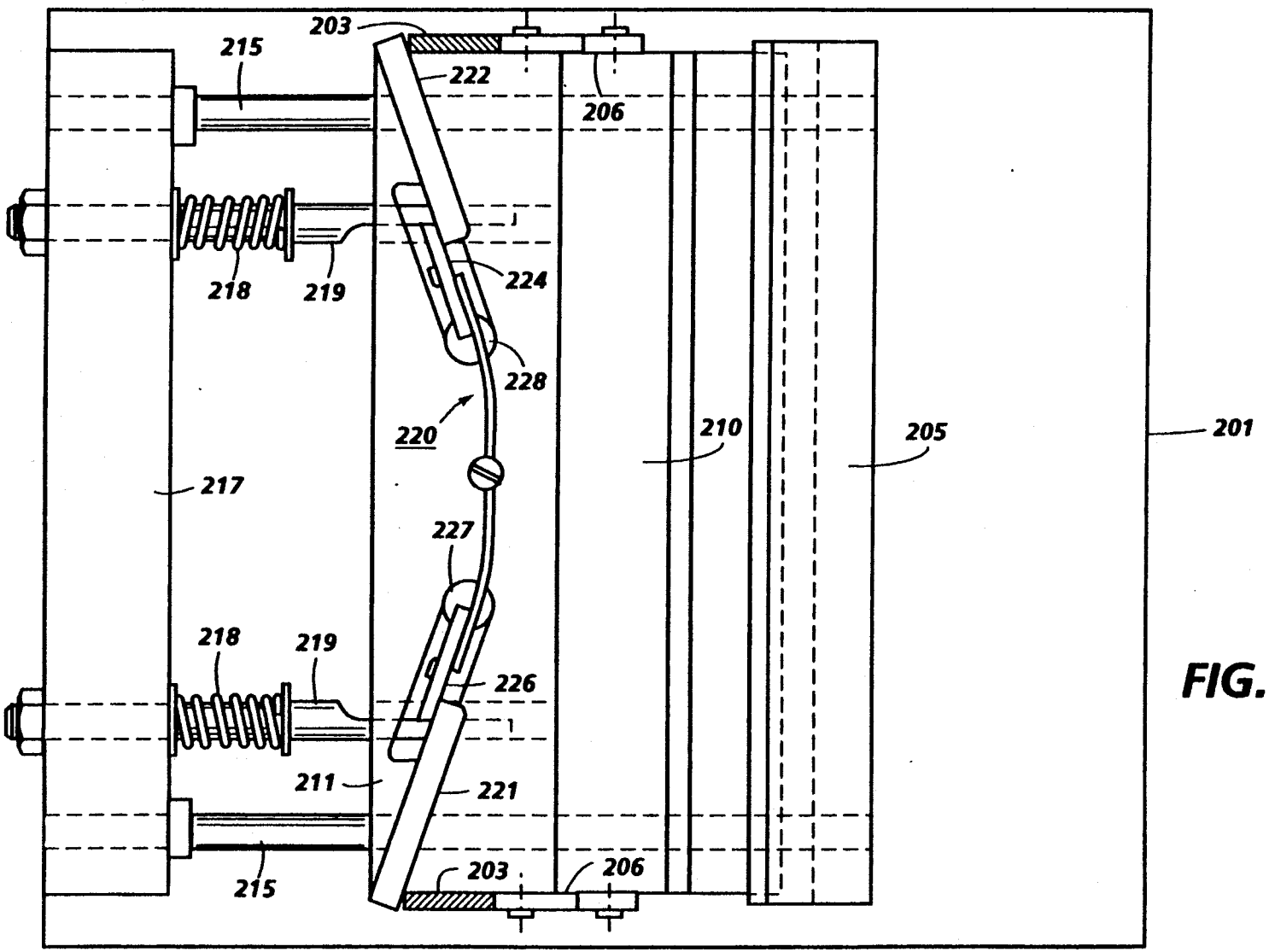
FIG. 12 is an enlarged plan view of the binder apparatus of FIG. 10.
Figure 13A:
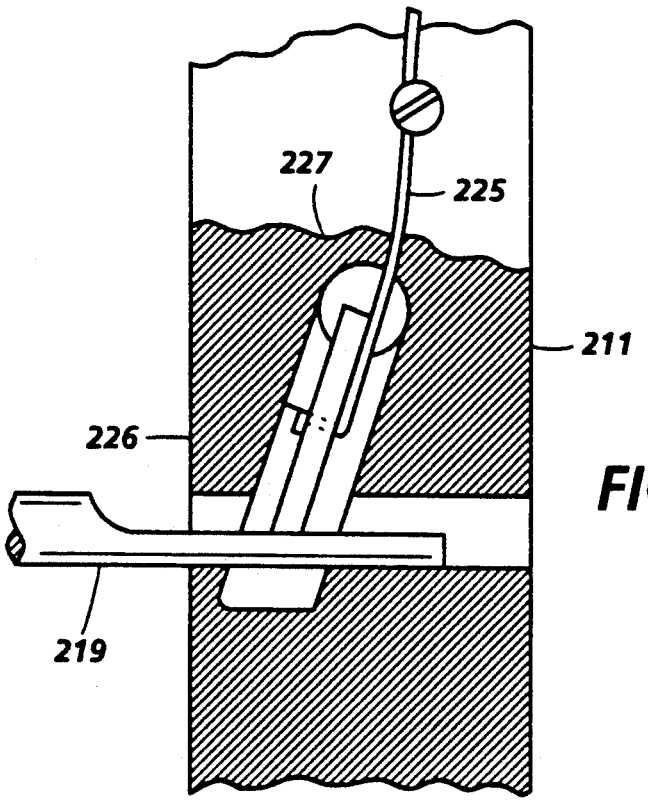
FIGS. 13A and 13B are enlarged plan and isometric views, respectively, showing the clamp bars of FIG. 12.
Figure 13B:
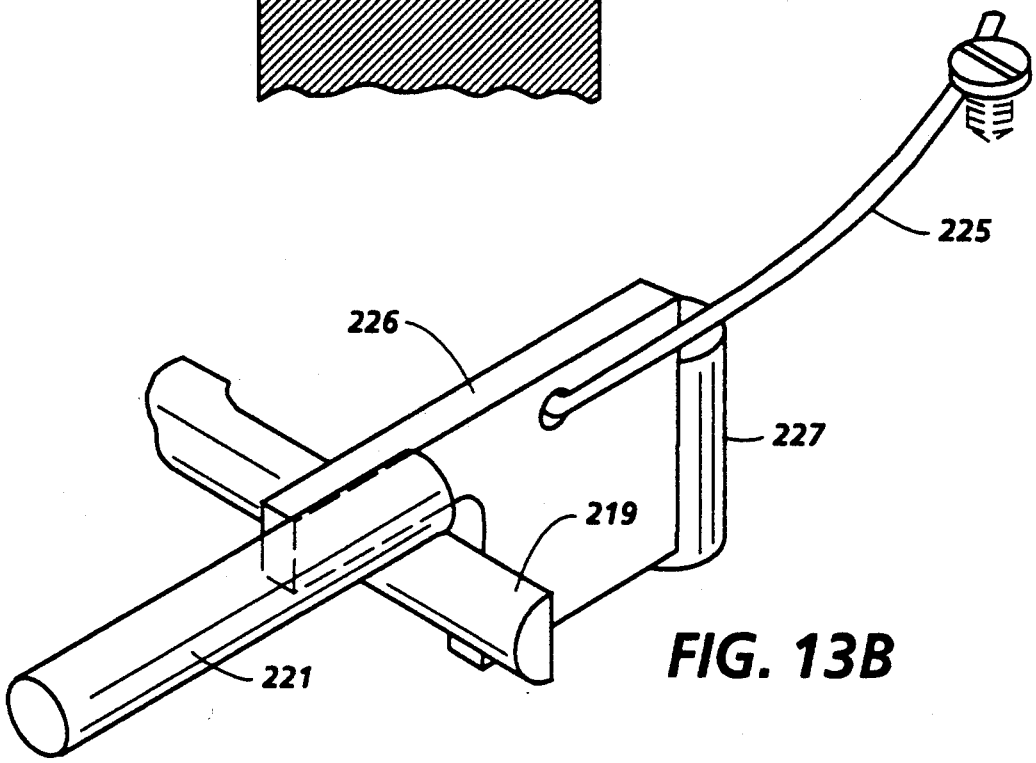

In FIGS. 10–13B, an alternative auto-adjust demand binding apparatus 200 is disclosed that comprises a base plate 201 on which is mounted a stationary jaw 205 and movable jaws 210 and 211. With reference to FIG. 10, handle 203 which pivots about shaft 204 is in its up or non-binding position. Movable jaw portions 210 and 211 are slidably mounted on guide rods 216 and held together by springs 207. Compression springs 218 are supported on drive rods 219 that extend through support block 217. As viewed in FIGS. 12 and 13A, a one-way belt locking friction clamp assembly 220 is used to permit the jaws to move forward during the first position of the stroke of handle 203, to lock during force application and then move back freely at the return stroke of the handle. The back end of each clamp bar 224/226 is fitted into a pivot rod 227 in order to distribute the load over a larger area. A single piece of spring steel wire 225 is used to provide the preload to keep both clamp bars in contact with the drive rods. Overtravel capability is provided by the springs 218 on the drive rods 219. The springs are preloaded to the force necessary to bind pages 28 into casebook 20. Up to that preload, the drive rods are immobile. When the preload is exceeded, the overtravel springs 218 compress and allow the drive rods to move backward under the load, avoiding overstressing the bind or the binder apparatus. Handle 203 rests against and actuates clamp release levers 221 and 222 in its non-binding position and includes a clinch cam 202 positioned adjacent cam follower 206. Friction (or alternatively a detent) is used at the handle pivot point to assure that the assembly of clamp bars, handle, jaws 210 and 211 and clamp assembly 220 moves forward before the clinching stroke begins. Thus, in operation, a bookcase with the properly selected size of bind channel is placed between guides 216 and onto the bed surface of jaw 210. Pages 28 of a book to be bound are placed within the casebook 20 and handle 203 is moved toward the operator through the first portion of the handle travel. This moves rear clinching jaw 211 as well as front clinching jaw 210 forward in unison until front clinching jaw 210 contacts the bookcase. This compensates for the various spine channel widths that are available. The next portion of handle motion brings the jaws 210 and 205 together with enough force to clinch the spine channel onto the pages of the book. The remaining travel of the handle compensates for various book thicknesses. This travel is taken up by overtravel springs 218 if not needed for the clinching operation. When the handle is returned to its starting position, it releases the friction clamp assembly 220 and the jaws move apart to their maximum opening to permit easy insertion of the next book, whatever its thickness.

Figure 14:
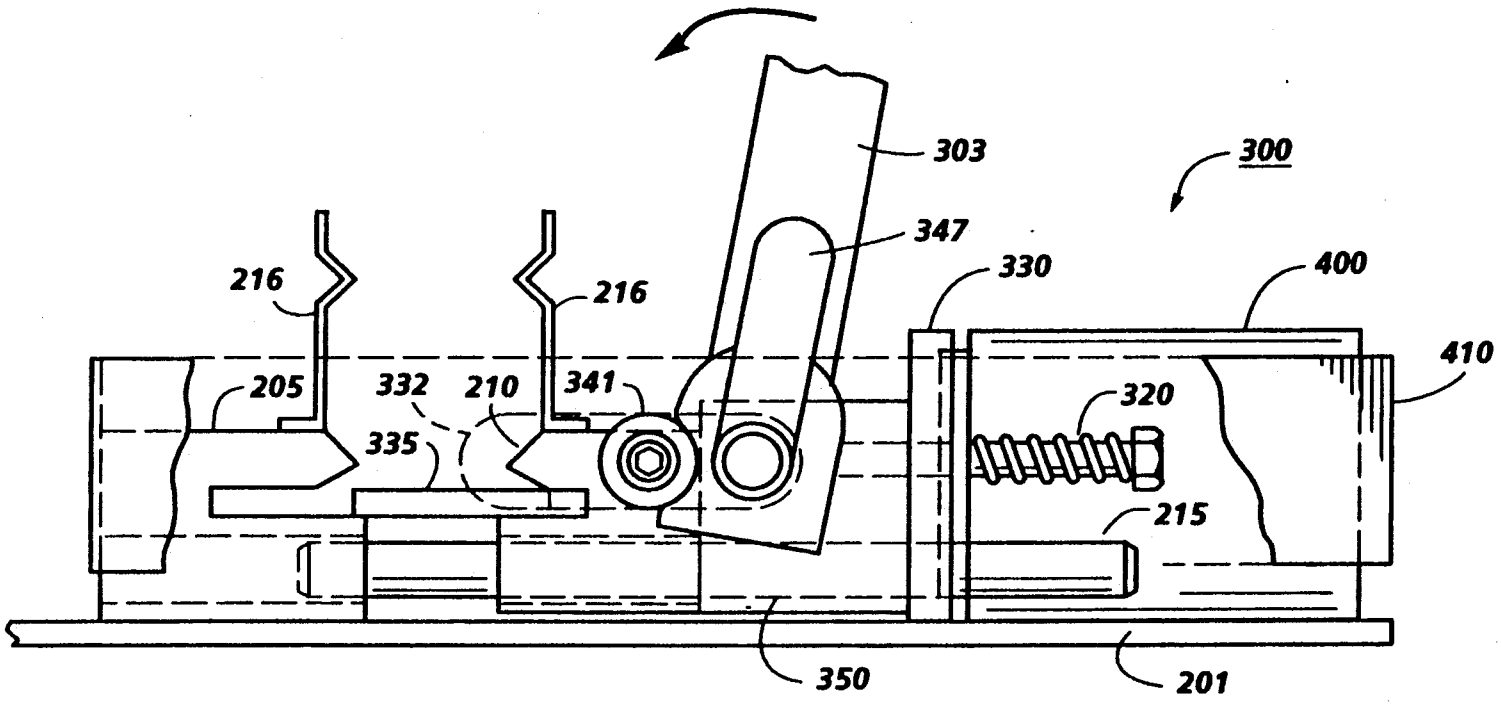
FIG. 14 is an enlarged partial side elevation of another alternative embodiment of the binder apparatus of the present invention with its actuating handle in an open position.
Figure 15:
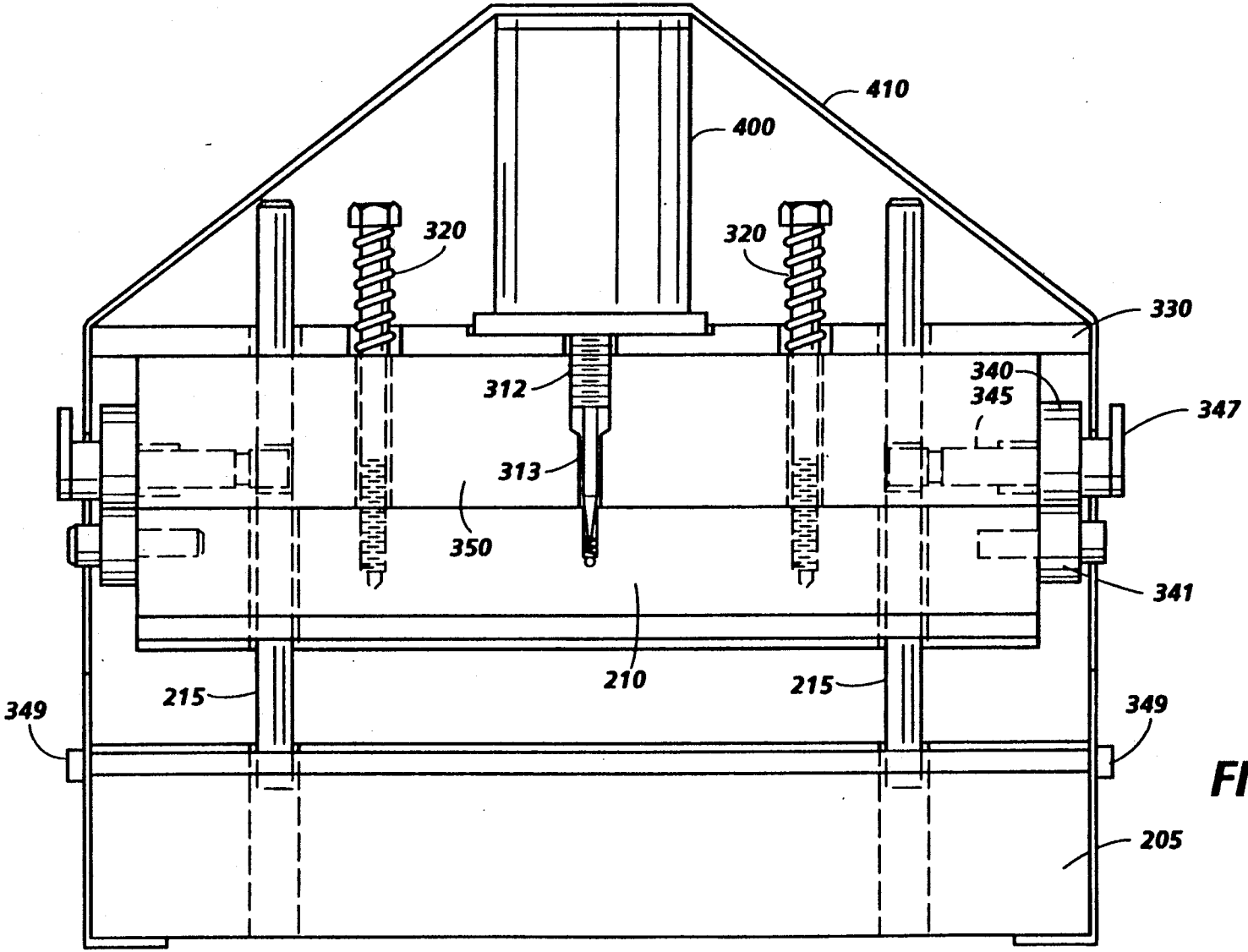
FIG. 15 is an enlarged partial plan view of the binder apparatus of FIG. 13.
Figure 16:
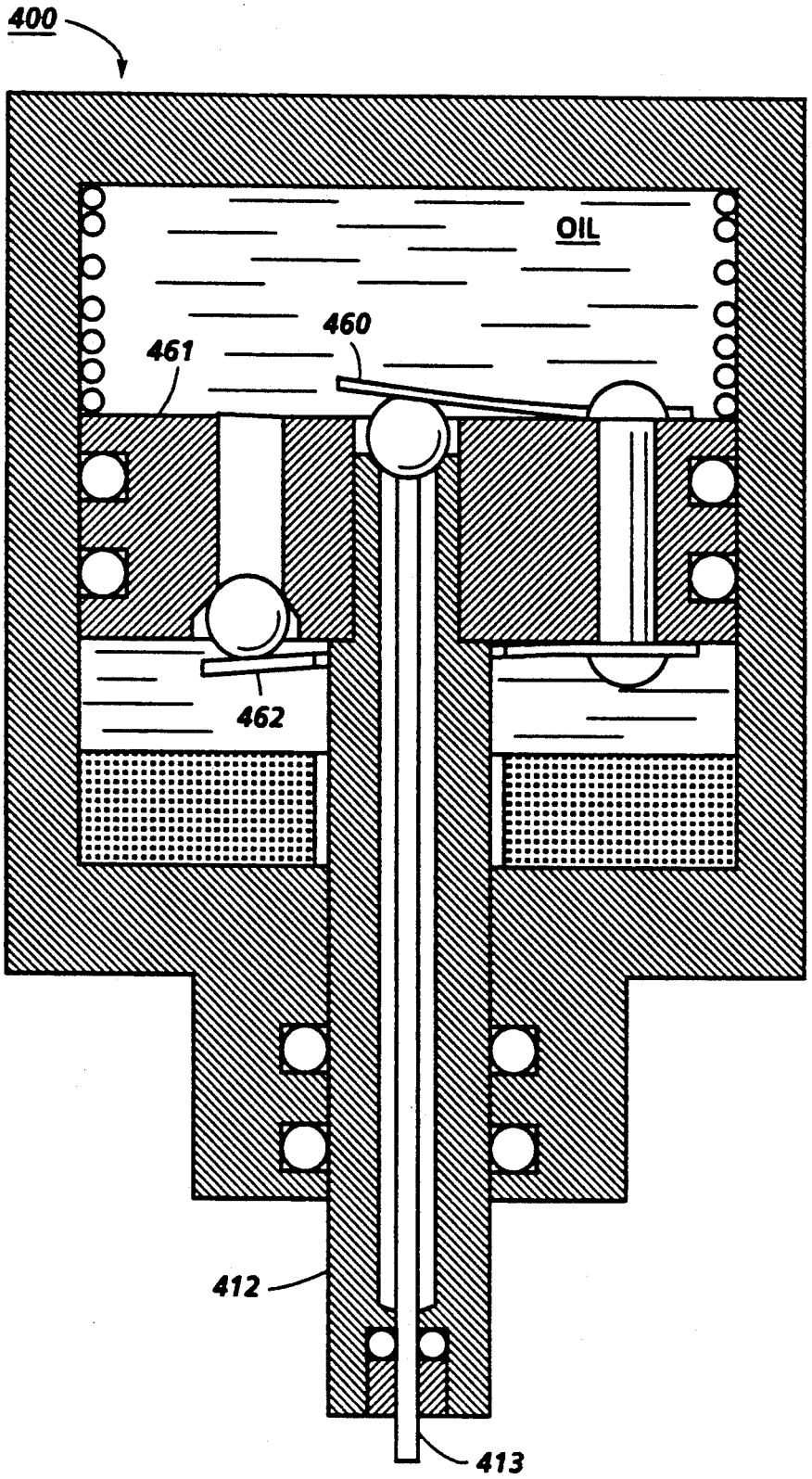
FIG. 16 is an enlarged side view of the overtravel force limiter hydraulic piston in accordance with the present invention.

In FIGS. 14–16, another embodiment of the present invention 300 is shown that is similar in construction and operation to the device of FIGS. 10–13B except that it is based on a force limiting hydraulic cylinder 310 having a release rod 313 used to unlock the cylinder during the adjustment and reset portions of the binding cycle. Binder 300 is supported on a base plate 201 which serves as a broad base to support the handle forces exerted by the operator. Fixed jaw 205 and cylinder mount plate 330 are attached to the base plate, but the majority of the binding forces are carried by a steel tension band 311 which surrounds the binder, rather than the base plate. This permits a sheet metal base plate to be used, if desired. The tension band is attached at its ends to the fixed jaw. It fits in locating notches in a cylinder end plate and in the cylinder mount plate. Wide slots 332 in the sides of the band provide clearance for a cam assembly that includes detent cam 340, can follower 341, and handle arm portion 347 that fits into arm 303. Band 311 also supports stops 349 that limit the downward motion of handle 303. The handle mounts to the handle arm portion 347 of the cam assembly and is outside the band. The cylinder is supported by the band at the rear end and by a recess in the cylinder mount plate at the front.

Force limiting hydraulic cylinder 400 has a hollow piston rod 410 that threads into pivot block 350 to transmit the binding force. The release rod 413 extends through a clearance hole in the pivot block and threads into the moving jaw. The moving jaw 210 is fixed to the two guides rods 215. The guide rods slide in bearings in the cylinder mount plate 330 and the fixed jaw 205. The moving jaw 210 slides on the guide rods when moved away from the pivot block 350 by the action of the cam 340 against the cam follower 341 which is attached to the moving jaw. The cam and cam follower are held in contact by the detent springs 320 which constantly pulls the moving jaw toward the pivot block. Cam 340, cam shaft 345, and handle arm portion 347 comprise a welded assembly which pivots in bearings in the pivot block.

When the binder 300 is operated, a bookcase with the properly selected size of bind channel is placed between guides 216 and onto the bed surface 335 of jaw 210. Pages of a book to be bound are placed within the casebook and handle 303 is moved forward and down toward the operator. During the forward portion of the stroke, the moving jaw is not in contact with the casebook, so the entire mounting jaw-pivot block assembly moves to the right. The handle is prevented from pivoting forward by the action of the detent springs and a detent pocket in the cam surface. Once the moving jaw reaches the casebook and is no longer free to move to the right, the continued motion of the handle forces the cam out of the detent position. The moving jaw then moves away from the pivot block under the influence of the cam. As soon as the pivot block and moving jaw separate, the release rod is pulled out of the force limiting cylinder enough to allow the internal check valve 460 to close. This prevents the flow of oil from chamber "A" to chamber "B" of the force limiting cylinder, preventing motion of piston 461, and locks the cylinder rod in place. As the handle continues its arc downward, the cam exerts force on the follower and moving jaw sufficient to complete the bind. When the bind is complete the jaws are pressing against a solid stack of paper and metal. The forces rise rapidly, increasing the pressure in chamber "A". When the pressure exceeds the setting of the pressure relief valve 462 in the force limiting piston, the valve opens, allowing the piston rod and pivot block to move to the left, absorbing the remaining overtravel stroke of the cam as the handle is depressed to its end stop. As the handle is returned to the detent position of FIG. 12, the cams allow the detent springs to move the pivot block and moving jaw back together. The release rod is pressed, and the check valve is opened, releasing the piston motion. The pivot block and moving jaw are then free to return to the "jaw fully open" position. The binder is then ready for the next book.

It should now be understood that a cost effective method for binding either hard covers or soft covers to either bound or unbound pages of a book is disclosed in which the bound or unbound book is captured with a metal U-shaped channel which is in turn bonded to the inside spine of the hard or soft covers. Sheets of heavier stock are adhered to both inside hard or soft covers with pressure sensitive tape. Provisions for affixing attractive titles to the front cover and to the spine are also included.

While the invention has been described with reference to the structures shown, it is not confined to the specific details set forth, but is intended to cover such modifications or changes as may come within the scope of the following claims.

What is claimed is:

1. In a case for binding pages of a book thereto and having a spine, the improvement comprising: a smooth inner surfaced U-shaped channel member, said U-shaped channel member being made of a material which reacts with plastic deformation when crimped around pages of a book; and means for attaching said U-shaped channel member interiorly of said spine.

2. The improvement of claim 1, wherein said U-shaped channel member is made of metal.

3. A soft cover case for binding pages of a book thereto, comprising: integral front and back covers including a spine portion between said front and back covers; and a smooth inner surfaced crimpable U-shaped channel member attached inside said spine portion of said soft cover case for receiving pages to be bound thereto, so that after said pages have been placed within said U-shaped channel member it is crimped to secure said pages thereto, said U-shaped channel member being made of a material which has the properties of and reacts with plastic deformation when crimped onto said pages.

4. A case for binding pages of a book thereto, comprising: integral front and back covers including a spine portion between said front and back covers; and a smooth inner surfaced crimpable U-shaped channel member attached inside said spine portion of said case for receiving pages to be bound thereto, so that after said pages have been placed within said U-shaped channel member it is crimped to secure said pages thereto, said U-shaped channel member being made of a material which has properties of and reacts with plastic deformation when crimped onto said pages.

5. A completed book including a plurality of pages, comprising: front and back covers; a covering material covering a major portion of said front and back covers, said covering material including a spine between said front and back covers; a plurality of pages; a crimped, U-shaped channel means, said channel means being made of a material which has the properties of and reacts with plastic deformation once it is deformed in order to hold said pages securely and having upstanding wall portions with smooth inner surfaces throughout that contact said pages, said upstanding wall portions being substantially orthogonal with respect to a longitudinal plane of said spine before they are crimped; and means for attaching said channel means to said spine, said channel means being adapted when said walls of said U-shaped channel means are crimped above said spine and below an upper end portion of said upstanding wall portions to secure said pages to channel means.

6. The completed book of claim 5, wherein said upstanding walls of said channel means are positioned inwardly toward each other after said channel means has been crimped around said plurality of pages.

7. The completed book of claim 5, wherein said means for attaching said binding member to said spine is an adhesive attached directly to the inner surface of said spine and said channel means is attached directly to said adhesive.

8. The completed book of claim 7, wherein said spine is flexible.

9. A completed book, comprising: front and back covers; a covering material covering a major portion of said front and back covers with a portion thereof including a spine between said front and back covers; and a binding member, said binding member being made of a material which has the properties of plastic deformation; means for attaching said binding member to said spine, said binding member being positioned on the inner surface of said spine and having sheets inserted between opposing, smooth inner surfaced, spring walls of said binding member that have been crimped above said spine and not beyond an upper end portion of said walls directly to an edge of the stack of sheets therebetween with a sufficient force and contact pressure to bind the sheets into a book.

10. A completed book including a plurality of pages, comprising: front and back covers; covering material surrounding a major portion of said front and back covers and forming a spine therebetween; a U-shaped channel member being made of a material which has the properties of plastic deformation and having smooth inner surfaces throughout that directly contact said pages; and means for attaching said channel member to the inner surface of said spine of said covering material for receiving the pages that have been crimped to thereby secure said pages to said channel member.

11. A completed book, comprising: front and back covers; covering material surrounding a major portion of said front and back covers and forming a spine therebetween; a binding member being made of a material which has the properties of plastic deformation and having a predetermined length, width and height and opposing, smooth inner surfaced, spring walls; and means for attaching said binding member to the inner surface said spine of said covering material, said binding member having sheets inserted between said opposing, smooth inner surfaced, spring walls of said binding member, and wherein said spring walls are in direct contact with and have been crimped to an edge of the sheets therebetween with a sufficient force and contact pressure to to bind the sheets into a book.

12. In a case for binding pages of a book thereto and having a spine, the improvement comprising: a U-shaped channel member having deformable spring walls with smooth inner surfaces throughout, and wherein at least one of said spring walls is adapted to be deformed toward one another beyond its modulus of elasticity into a crimped position in which the deformed opposing upstanding walls securely crimp an edge of the pages inserted therebetween with sufficient force and contact pressure to bind the pages into said channel member; and means for attaching said U-shaped channel member to said spine.

13. The improvement of claim 12, wherein said U-shaped channel member is made of metal.

14. A case for binding pages of a book thereto, comprising: front and back covers, a covering material surrounding a major portion of said front and back covers, said covering material including a spine between said front and back covers; and a smooth inner surfaced U-shaped channel member attached inside said covering material to said spine between said front and back covers for receiving said pages, said U-shaped channel member being made of a material which reacts with plastic deformation when crimped around pages of a book.

* * * * *